United States Patent [19]

Baldini et al.

[11] 3,969,800

[45] July 20, 1976

[54] STRETCHING DEVICE FOR FILAMENTS OR STRANDS

[75] Inventors: Giorgio Baldini; Gianpietro Trentini, both of Turin, Italy

[73] Assignee: Beloit Corporation, Beloit, Wis.

[22] Filed: Sept. 30, 1974

[21] Appl. No.: 510,159

Related U.S. Application Data

[63] Continuation of Ser. No. 284,210, Aug. 28, 1972, abandoned.

[52] U.S. Cl. ..... 28/71.3

[51] Int. Cl.[2] ..... D02J 1/22

[58] Field of Search ..... 28/62, 71.3, 61, 63; 26/6; 57/34 HS; 219/10.61, 388; 432/8, 59

[56] References Cited

UNITED STATES PATENTS

| | | | |
|---|---|---|---|
| 1,665,287 | 4/1928 | Swanson | 28/71 |
| 2,020,704 | 11/1935 | Sneirson | 28/70 |
| 2,674,809 | 4/1954 | Meienhofer | 219/388 UX |
| 3,238,592 | 3/1966 | Killoran et al. | 28/71.3 X |
| 3,276,095 | 10/1966 | Killoran et al. | 28/71.3 |
| 3,461,519 | 8/1969 | Raschle | 28/62 |
| 3,551,971 | 1/1971 | Lehner | 28/71.3 |
| 3,728,518 | 4/1973 | Kodaira | 28/62 X |

FOREIGN PATENTS OR APPLICATIONS

| | | | |
|---|---|---|---|
| 683,526 | 3/1964 | Canada | 28/71.3 |
| 42-2614 | 4/1967 | Japan | 28/71.3 |
| 984,902 | 3/1965 | United Kingdom | 28/62 |
| 996,908 | 6/1965 | United Kingdom | 28/62 |

OTHER PUBLICATIONS

Siclari et al., Def. Pub. of Ser. No. 253,115 filed May 15, 1972, on Apr. 17, 1973, Def. Pub. No. T909,018, 28/62 X.

*Primary Examiner*—Robert R. Mackey
*Attorney, Agent, or Firm*—Hill, Gross, Simpson, Van Santen, Steadman, Chiara & Simpson

[57] ABSTRACT

A mechanism for producing plastic filaments including a means such as an extruder for supplying continuous plastic filaments, drawing the filaments over an arcuate nonfriction surface of a heated heat transfer plate in heat transfer engagement therewith while subjecting the filament to radiant heat opposite the plate, and applying an axial stretching tension to the filament.

4 Claims, 2 Drawing Figures

II
II
10
11
12
13
14
15
16
17
18
19
19a
20
21
22
23
23a
25
26
D-1
D-2

STRETCHING DEVICE FOR FILAMENTS OR STRANDS

This is a continuation of application Ser. No. 284,210, filed Aug. 28, 1972, now abandoned.

BACKGROUND OF THE INVENTION

The present invention relates to improvements in mechanisms for an improved multifilament extrusion process and more particularly to an improved heating mechanism for heating and stretching plastic raffia or filaments or similar material.

In mechanisms for producing extended plastic filaments used in the production of rope or for like purposes, the material is extruded and stretched. In materials such as polypropylene in filament or raffia state, the filaments are heated to a predetermined temperature while applying an axial force. The filaments may be in circular or flat form, and in the flat form provide tape yarns which are employed for textile or rope uses. The yarns or filaments must be stretched with the application of an axial tension, and they are pulled a predetermined amount at a predetermined temperature to a point where the material forms a hair-like structure. This grain direction orientation greatly strengthens and conditions the material for its end use. It is known that molecular orientation of all plastic materials from which yarns may be obtained by means of extrusion increases their toughness as a function of the stretching ratio.

In this operation a critical portion is the application of heat. The filaments are usually provided directly from an extruder or from rolls on which they have been wound when previously extruded and are supplied in multistrands through a heat source for stretching and elongating. The application of heat must be controllable and applied rapidly and uniformly in order to obtain relatively high production speeds. In devices heretofore available because of difficulties encountered in using high speed heated air blown countercurrently to the stretched filaments, it has been impossible to obtain satisfactory production speeds, and speeds limited to 100 meters per minute have been common, higher speeds causing strong weakening and size reduction of the filaments and finally their breaking.

It is an object of the present invention to provide an improved stretching and heating mechanism for the manufacture of plastic such as polypropylene in the filament or raffia state capable of higher operating speed on the order of 250 – 300 meters per minute. On an experimental laboratory equipment, speeds up to 700 meters per minute were also obtained.

A further object of the invention is to provide a mechanism for producing stretched plastic filaments which is capable of more uniformly and more satisfactorily heating the filaments during the stretching stage.

A feature of the invention is drawing the filaments over antifriction high temperature resistant material to heat the filaments by conductive heat while simultaneously subjecting the filaments to radiant heat from a heater opposite the surface while applying the tensile axial stretching force to the filaments to draw them over the arcuate surface.

Other features, objects and advantages will become more apparent, as will equivalent structures which are intended to be covered, in the teaching of the principles of the invention in connection with the disclosure of a preferred embodiment thereof in the specification, claims, and drawings, in which:

DESCRIPTION OF THE PREFERRED EMBODIMENTS

Figures 1, 2:
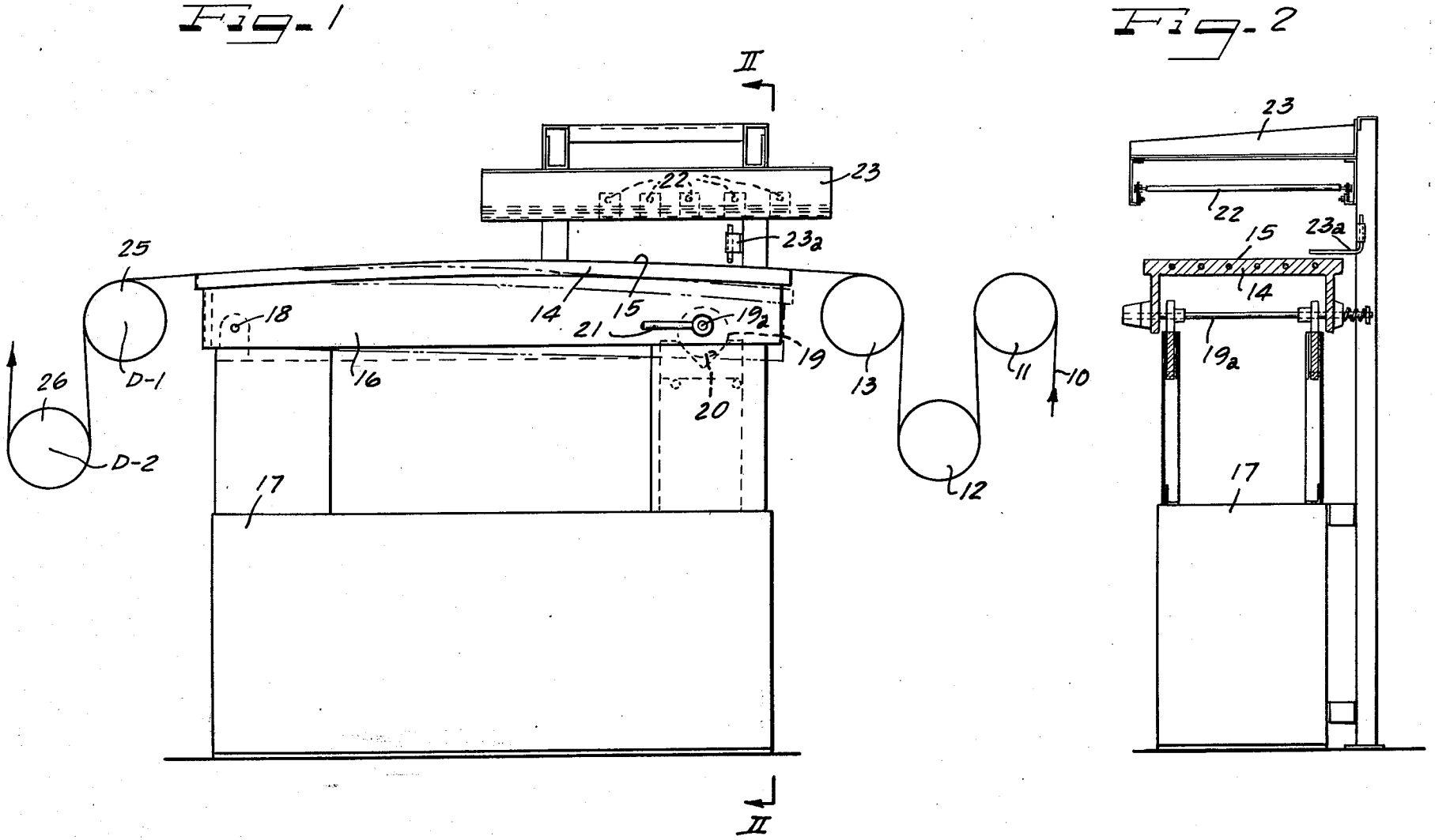
FIG. 1 is a side elevational view of a mechanism for heating and stretching plastic filaments in accordance with the principles of the present invention.
FIG. 2 is a vertical sectional view taken substantially along line II—II of FIG. 1.

As illustrated in FIGS. 1 and 2, a plurality of strands 10 of plastic such as polypropylene in the raffia or filament form are supplied. The filaments may be supplied directly from an extruder or from unwinding rolls. As illustrated, the mechanism includes a heater although the filaments 10 may be supplied from another heater. The filaments thread in a serpentine fashion over a series of supply rolls 11, 12 and 13 which may be driven at a variable velocity, but all the rolls of this series are driven at the same velocity. As the filaments pass over the heater, they move onto a series of additional tension rolls illustrated at 25 and 26, and it will be understood that a substantial additional number of rolls may be provided. These rolls are driven at a variable velocity, but all the rolls of this series are driven at the same velocity, which is generally greater than that of the supply rolls 11, 12 and 13 so as to create a speed differential between the two series and thus tension the filaments. The speed differential may be in the range of from 1:1 up to 1:12 according to the type of plastic material, sizes of the strands, quality requirements and so forth.

A plurality of filaments may be supplied from separate spools having been wound from an extruder, with the filaments being substantially separated at the supply and in fan-shape converge together onto the supply rolls. The supply rolls are those shown at 11, 12 and 13 while the tension rolls 25 and 26 apply a stretching force to the filaments or strands of 0.75 kg/cm$^2$ as an average, but greatly variable according to the kind of plastic filaments being processed. Heat must be applied to the filaments to accommodate stretching, and this is accomplished by passing the filaments over a curved plate 14 which has an arcuate frictionless upper surface 15. The plate preferably has a broad radius of curvature on the order of 7,500 millimeters. The length of the plate is approximately 1,200 millimeters. The operating temperature of the plate is normally at 120°C, but adjusting means are provided which permits, at the beginning of a run, variance of the temperature according to the kind of plastic material being treated (100°C – 150°C). The upper surface of the plate is coated with a temperature resistant nonfriction material such as polyfluoroethylene (Teflon). With this arrangement, the axial pull on the filaments is applied uniformly, and the material does not stretch unequally due to frictional resistance against the surface. By maintaining the tension on the filaments, good heat contact is maintained between the filaments and the surface so that the filaments are heated by conduction and by radiation.

Positioned above the plate opposing the filaments are a series of infrared heater elements 22. These are supported in a bank on a head 23 which may be vertically adjustable. A temperature sensor **23*a* may be mounted above the surface for sensing the temperature of the air above the filaments. The sensor 23*a* transmits the data of the sensed temperature to a SCR (Silicon Controlled Rectifier, not shown) which in turn controls temperature of the heaters 22 by increasing or decreasing voltage feed to heaters 22 as a function of yarn speed, yarn diameter, kind of material of the filaments, their softening point, cross-sectional shape of the strands, velocity of passage, keeping the temperature at the strands so as not to soften the filaments. Width of the plate 14** may be varied according to the number of filaments to be treated at the same time.

The plate 14 is mounted on a pivotal support which is carried on a pivotal pin 18 on its trailing end. The pin supports a bed 16 which carries the plate, and the pin is mounted on dogs on a frame 17. At the leading end of the bed is an adjustable support in the form of a cross-shaft 19*a* carrying a cam 19 which seats in a V-shaped support notch 20. The cam 19 is centrally mounted on the shaft 19*a*, and the shaft is rotated by a handle 21 to raise and lower the lead end of the plate. The plate is shown uppermost in its solid line position, and at its lowermost location in the dotted line position. Preferably, the plate is brought up to a position so that the strands smoothly feed onto the upper surface maintaining substantially uniform normal contact pressure with the plate surface over the entire length of their travel. Flat strands are normally held in contact for a major proportion of the plate length, while round strands are kept tangential to the plate.

In operation the rollers continue to apply tension to the strands, which are spaced close together for the entire length of the rollers across the width of the plate, and they are heated in sliding travel over the plate and continue to be stretched while they are heated and for their travel over the succeeding rollers. By control of the relative speed of the rollers, which is accomplished by separately controllable drives shown at D-1 and D-2 for the rollers 25 and 26, the amount of axial force on the strands can be controlled. Similar drives are provided for each of the rollers for the strands.

As the filaments are subsequently subjected to stabilization for removing residual elasticity from them, in a subsequent stage (not shown) and in a plant with 24 hour operation, rollers 25, 26 are heated by the hot filaments or have a temperature which is nearly the same as the filaments, it is necessary that the first roller 25 of the series of tensioning rollers is a cooled roller, for instance by means of a cooling water circulation system (not shown).

We claim as our invention:

1. A mechanism for producing plastic filaments comprising in combination:

means for supplying continuous filaments of plastic, said filaments extending from a delivery roll to a receiving roll;

a heating means having an arcuate heat transfer surface positioned to be contacted by said filaments with said filaments wrapping said arcuate surface and sliding therealong in a circumferential direction in heat transfer engagement therewith;

radiant heating means opposite said heat transfer surface for heating said heat transfer surface to a predetermined temperature for heating said filaments;

means for applying a continuous axial tension to said filaments holding them in sliding heat transfer surface engagement with said heat transfer surface;

and means for adjusting the position of said heat transfer surface toward or away from the path of travel of said filaments so as to change the length of arc on said heat transfer surface contacted by said filaments so that the time of engagement of said filaments with said heat transfer surface is changeable, said adjusting means including a pivotal support for the trailing end of said heat transfer surface adjacent said receiving roll and adjustable means for moving the leading end of said heat transfer surface adjacent said delivery roll to change said length of arc on said heat transfer surface contacted by said filaments whereby the location where said filaments first engage said heat transfer surface is variable.

2. A mechanism for producing plastic filaments constructed in accordance with claim 1:

wherein said adjusting means for adjustably moving the leading end of said surface includes a rotatable cam and follower changing the position of the leading end of said heat transfer surface.

3. A mechanism for producing plastic filaments constructed in accordance with claim 1:

wherein said heating means is embedded within said heat transfer surface.

4. A mechanism for producing plastic filaments constructed in accordance with claim 1:

wherein said axial tension applying means extends said filaments.

* * * * *